US006591801B1

(12) United States Patent
Fonville

(10) Patent No.: US 6,591,801 B1
(45) Date of Patent: Jul. 15, 2003

(54) ENGINE COVER BALANCED ISOLATED SUPPORT AND SEAL

(75) Inventor: Carl Eric Fonville, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/167,013

(22) Filed: Jun. 11, 2002

(51) Int. Cl.[7] ..... F01M 9/10

(52) U.S. Cl. ..... 123/90.38; 123/195 C; 123/198 E; 277/313; 277/591

(58) Field of Search ..... 123/90.38, 195 C, 123/198 A, 198 E; 277/592, 922, 312, 314, 316, 650, 313, 591; 156/60, 305; 181/204; 411/368–369

(56) References Cited

U.S. PATENT DOCUMENTS 4,975,008 A * 12/1990 Wagner ..... 411/337
5,397,206 A * 3/1995 Sihon ..... 411/544
5,513,603 A * 5/1996 Ang et al. ..... 123/90.37

* cited by examiner

*Primary Examiner*—Thomas Denion
*Assistant Examiner*—Kyle Riddle
(74) *Attorney, Agent, or Firm*—Leslie C. Hodges

(57) ABSTRACT

A sealed cover, such as an engine valve or rocker cover, is mounted on an engine with balanced grommets which support the cover through equal compression loads on inner and outer sides of the cover. A sealing surface of the cover is positioned with a fixed gap from a facing sealing surface of a cylinder head or other engine component. The gap is sealed by a liquid RTV seal material that is vulcanized in place at room temperature after installation of the cover. The arrangement separates the function of noise isolation from the sealing function performed by the RTV material so that the specifications of the sealing material and the noise isolating grommet material can be varied as desired to perform their separate functions without a change in one affecting the other.

8 Claims, 2 Drawing Sheets

ENGINE COVER BALANCED ISOLATED SUPPORT AND SEAL

TECHNICAL FIELD

This invention relates to engine covers, such as valve or rocker covers, and to their mounting on an engine for noise isolation and sealing.

BACKGROUND OF THE INVENTION

It is known in the art relating to engine valve and rocker covers to provide a gasket and grommet mounting and noise isolation system which interrelates the sealing performance and noise isolation in provision of a robust cover design. Noise isolation is provided by mounting a cover with a grommet at each hold down bolt location and by a peripheral molded seal or gasket between the cover and the engine cylinder head or block which separates the cover from direct metal to metal contact. The forces required to seal the molded gasket may be unevenly applied because of variations in bolt pattern and spacing resulting in differing grommet loads and sealing variations at various locations around each part. Control of noise isolation may be compromised due to non-uniform compression sealing of the gasket, varying grommet loads and reaction distortions in the cover. An improved cover mounting system which separates the noise isolation and sealing functions is accordingly desired.

SUMMARY OF THE INVENTION

The present invention provides for mounting of a sealed cover, such as an engine valve or rocker cover. The cover is mounted on the engine with balanced grommets which support the cover through equal compression loads on inner and outer sides of the cover. Thus, a sealing surface of the cover is positioned with a fixed gap from a facing sealing surface of an associated engine component. The gap is sealed by a liquid RTV seal material that is vulcanized in place at room temperature after installation of the cover. The arrangement separates the function of noise isolation from the sealing function performed by the RTV material so that the specifications of the sealing material and the noise isolating grommet material can be varied as desired to perform their separate functions without a change in one affecting the other.

The grommet design is made such that it applies load equally to both inner and outer surfaces of the cover at its mounting holes. For this purpose, the grommet is formed with an equal mass of resilient material in inner and outer portions on opposite sides of the cover mounting opening. A through bolt and a height limiting sleeve are utilized to secure the cover and compress the grommet to a fixed dimension above the associated engine mounting surface. Since the compression of both portions of the grommet is equal, the center of the cover mounting opening is maintained with equal spacing between the compression members represented by the bolt head and the height limiting sleeve.

The design is such as to support the cover sealing surface with a fixed gap in opposition to the associated engine sealing surface so that the RTV sealing material which is put in place prior to mounting the cover on the engine is maintained in position without any compression load applied by the cover against the RTV seal. Since there is no cover load on the seal, the seal does not apply any reaction load against the cover and therefore there is no distortion of the cover or the noise isolation grommets that would result in changing the loading of the seal or the isolating functions of the grommets. Accordingly, the stiffness or isolating characteristics of the grommets may be altered for improved noise isolation without having any effect on the RTV seal material. Also, the seal material and the gap in which the material is located may be altered in design variations in order to provide a more effective seal without having any effect on the noise isolation characteristics of the grommets.

These and other features and advantages of the invention will be more fully understood from the following description of certain specific embodiments of the invention taken together with the accompanying drawings.

DESCRIPTION OF THE PREFERRED EMBODIMENT

Figure 1:
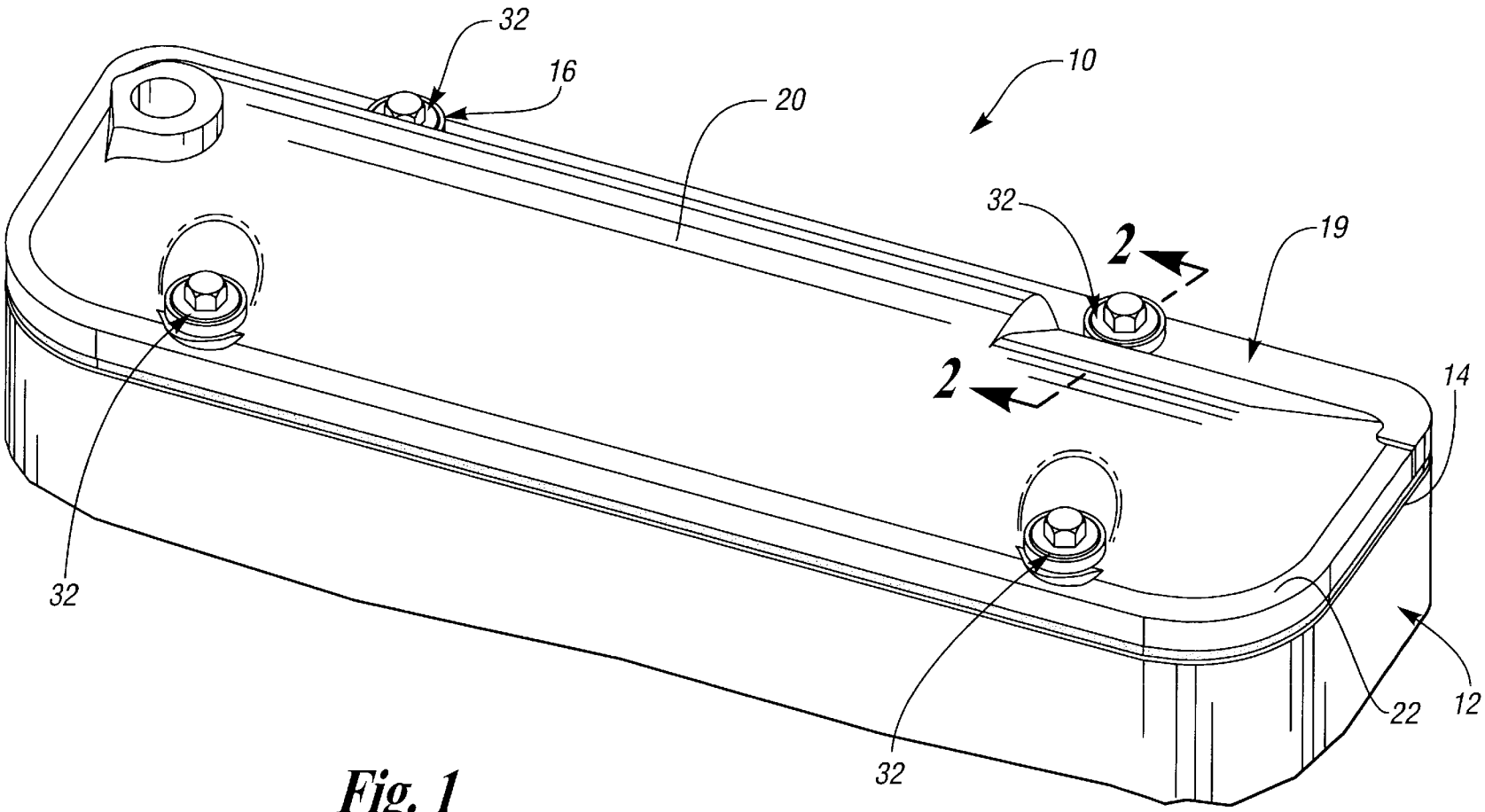
FIG. 1 is a pictorial view showing an exemplary embodiment of engine rocker cover mounted upon an open top of an associated engine cylinder head in accordance with the invention.
Figure 2:
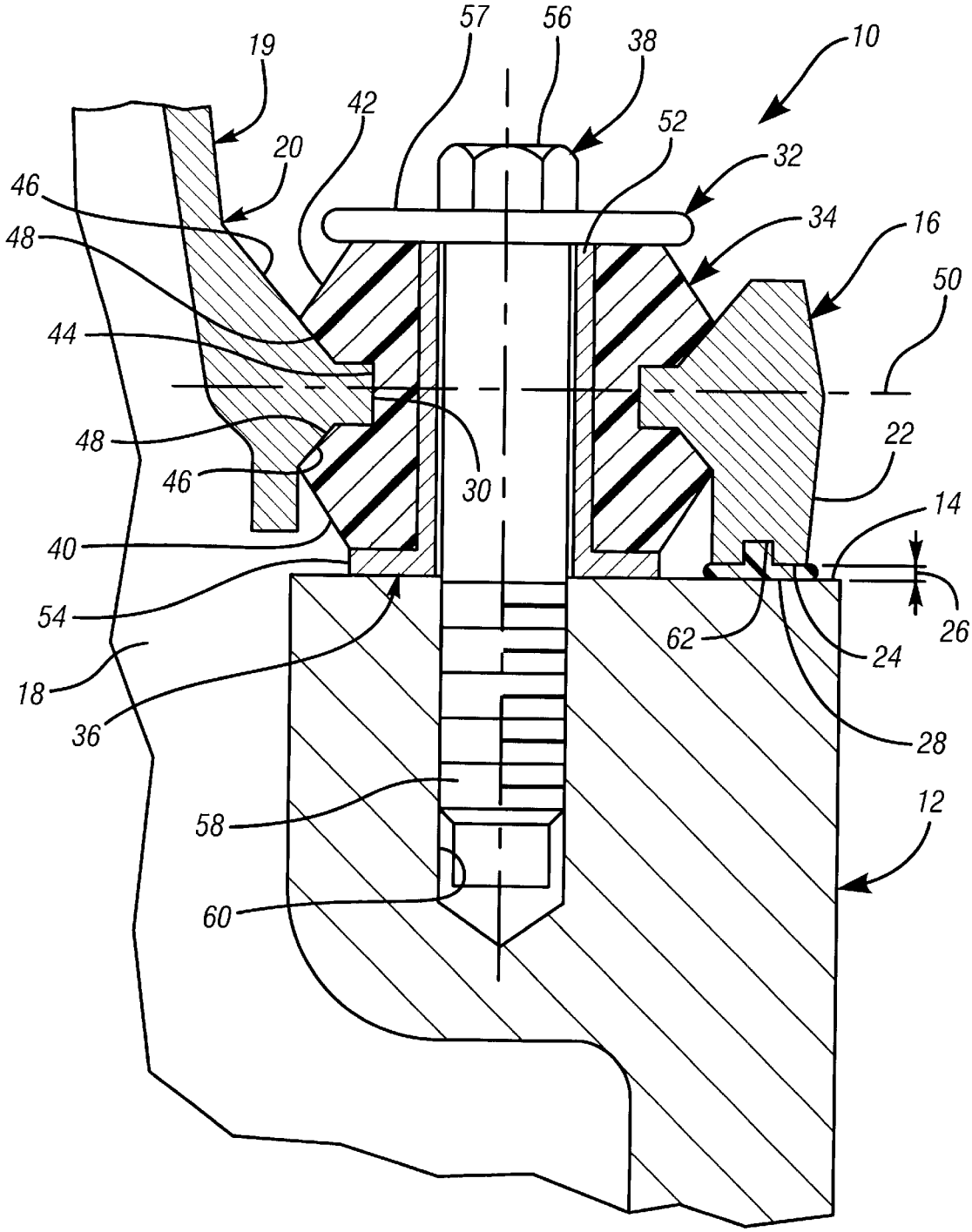
FIG. 2 is a transverse cross-sectional view taken along the line 2—2 of FIG. 1.

Referring to the drawings in detail, numeral 10 generally indicates a portion of an engine assembly including at least one cylinder head 12 having an open top with an outwardly facing generally planar sealing surface 14. The open top is closed by a sealed cover assembly 16 according to the invention and defining with the cylinder head an internal fluid containing cavity 18 (see FIG. 2).

The sealed cover assembly 16 includes a cover 19 having a fluid-containing wall 20 surrounded by a peripheral edge 22 with an inwardly facing sealing surface 24 spaced by a predetermined gap 26 from the outwardly facing sealing surface 14 of the cylinder head. The gap 26 is filled with a suitable sealing material, such as an RTV sealing material 28, which is applied in liquid form and cures at room temperature after installation of the cover 19.

The cover assembly 16 includes a plurality of, in this case four, mounting openings 30 in each of which is retained a mounting assembly 32 including a grommet 34, a height limiting sleeve 36 and a bolt 38, extending through the sleeve. The grommet 34 is preferably molded as a one-piece integral member having identical inner and outer portions 40, 42, respectively, separated by a central groove 44. The hardness and compression rate of the grommet material are preferably uniform throughout the molded grommet so that the opposite inner and outer portions of the grommet compress equally from an extended initial length to the installed length shown in the drawing. Hardness and compression of the grommet are pre-selected as desired to support the cover 19 and to control noise isolation of the cover from the vibration of the cylinder head and engine.

The groove 44 of the grommet is positioned within the opening 30 of the cover 19, which engages the groove 44. Adjacent angular surfaces 46 of the cover engage correspondingly angled surfaces 48 of the grommet inner and outer portions spaced equally on opposite sides of a neutral plane 50 passing through the middle of the mounting opening 30 and the groove 34.

The sleeve 36 has a height limiting tubular body 52 terminating at a radial flange 54 on the inner end of the body. The flange 54 is engaged by the inner end of the grommet 34 facing the cylinder head sealing surface. The bolt 38 includes a head end 56 incorporating a flange 57 that engages the outer end of the grommet 34. The main body of the bolt extends through the sleeve body 52 with a threaded end 58 protruding beyond the flange 54. A mounting assembly 32 is installed within each of the four cover openings 30 and is retained within its respective opening by any suitable means to form the sealed cover assembly adapted for assembly onto the cylinder head.

For mounting of the cover assembly on the cylinder head, cooperating threaded openings 60 are provided in the cylinder head into which the ends 58 of the bolts are threaded to mount the cover 19 onto the cylinder head 12. Prior to the assembly step, a bead of RTV sealing material in liquid form is applied either to the sealing surface 24 of the cover or to the opposing sealing surface 14 of the cylinder head. The cover assembly 16 is then positioned opposite the engine sealing surface 14. The bolts 38 are then threaded into their corresponding openings 60 in the cylinder head and tightened down until the bolt head flanges 57 engage the sleeves 52, which establishes the pre-determined compression of the grommets. Because of their balanced design, compression of the grommets is equal on both sides of the neutral plane 50 so that the mounting forces applied thorough the grommets 34 on the cover 19 are balanced. The cover is thereby retained in a position with its sealing surface 24 spaced outward, by the predetermined gap dimension 26, from the sealing surface 14 of the cylinder head.

The gap 26 is filled by the RTV liquid sealing material 28, which becomes self-vulcanized or cured at room temperature in a short period of time after assembly. The sealing surface 24 of the cover optionally includes a groove 62 into which some of the RTV material is displaced so that, when it is cured, the interaction with the groove prevents the sealing material from being easily dislodged from the gap between the sealing surfaces and maintains the sealing material in position under all conditions of operation of the engine.

The sealed cover assembly 16 with an engine assembly 10 as described above provides several benefits that improve both the noise isolation capabilities and sealing performance of the sealed cover assembly by making these functions essentially independent of one another. The sealing provided by the RTV material is accomplished with no initial stress applied to the RTV seal by the cover since the gap dimension is maintained fixed by the grommet mounting arrangement. Any variations in the gap due to tolerance stack up or other causes are accommodated upon installation of the cover by the RTV material itself, which is able to fill in variations in the gap as well as surface irregularities and thus provides a dependable fluid containing seal between the cover and cylinder head.

Since there is no initial load applied between the cover and the cylinder head, there are no forces which tend to distort the cover or load the grommets except for the installed compression forces on the grommets, so that both the cover and the sealing material are free from loading forces which might affect the sealing performance of the material. Noise isolation requirements of the cover can be designed to provide ideal sound absorbing conditions, since the grommets are solely used to support and isolate the cover and are not required to apply any load against the cylinder head for sealing purposes.

The design of the cover assembly promotes a long life installation since the position of the cover is balanced by the grommets at all attachment points so that no distortion or rotation of the cover due to gasket reaction loadings occurs. Thus, alternative cover materials which provide ideal mass and cost considerations may be utilized without concern as to substantial stresses placed on the cover by having to load a seal material against the cylinder head.

While the exemplary cover assembly design illustrated involves a number of specific design considerations, the balanced grommet concept can be utilized with other cover designs to isolate a cover of any type from an associated engine component on which it is mounted. If desired, the integral grommets 34 could be replaced by separate individual inner and outer grommets forming grommet assemblies having equal compression characteristics to provide the balanced mounting assembly of the invention. However, a single grommet 34 for each mounting location is preferred for ease of manufacture, assembly and parts retention. If necessary, a low compression seal could be utilized in place of the RTV sealing material. However, in such a case, some minimum amount of load would have to be applied by the mounting system on the cover for maintaining the seal against the associated engine component for sealing purposes.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A sealed cover assembly for a fluid-containing cavity of an engine, the cover assembly comprising:

a cover including a fluid-containing wall with a peripheral edge having a sealing surface adapted to oppose a corresponding sealing surface of an engine, and a plurality of mounting openings in the wall;

at least one support grommet adjacent each of the openings and including balanced inner and outer portions engaging opposite sides of the wall and having essentially equal compression characteristics; and mechanical fasteners extending through the grommets for securing the cover to a mating edge of the engine cavity, the fasteners when engaged providing equal compression forces on the inner and outer portions of the grommets and supporting the cover sealing surface with a predetermined gap from the cavity mating edge for engagement with a compliant sealing material disposed between the surfaces.

2. A sealed cover assembly as in claim 1 including a settable sealing material engaging the cover sealing surface for closing the gap and preventing the escape of fluid from an engine cavity closed by the cover.

3. A sealed cover assembly as in claim 2 wherein the sealing material is an RTV compound.

4. A sealed cover assembly as in claim 2 wherein the cover sealing surface includes a linear groove for receiving the sealing material prior to setting of the material after installation of the cover assembly.

5. A sealed cover assembly as in claim 2 wherein the compliant sealing material is a low compression seal.

6. A sealed cover assembly as in claim 1 wherein the inner and outer portions of each support grommet are integrated in a unitary grommet member.

7. A sealed cover assembly as in claim 1 wherein the fasteners include a height controlling sleeve and a bolt extending through the sleeve and adapted to compress both inner and outer portions of the at least one grommet to a predetermined height whereby the predetermined gap is obtained between the peripheral sealing surface of the cover and the engine sealing surface.

8. An engine cover assembly defining a fluid-containing cavity the assembly comprising:

an engine component including a sealing surface defining an edge of the cavity;

a cover including a fluid-containing wall surrounded by a peripheral edge and having a sealing surface opposing the sealing surface of the engine component, and a plurality of mounting openings in the wall;

at least one support grommet adjacent each of the openings and including balanced inner and outer portions engaging opposite sides of the wall and having essentially equal compression characteristics; and mechanical fasteners extending through the grommets and engaging the engine component for securing the cover to the engine component, the fasteners providing equal compression forces on the inner and outer portions of the grommets and supporting the body sealing surface with a predetermined gap from the component sealing surface for engagement with a compliant sealing material disposed between the surfaces.

* * * * *